US008253515B2

(12) United States Patent
Hsu

(10) Patent No.: US 8,253,515 B2
(45) Date of Patent: Aug. 28, 2012

(54) BAND-PASS FILTER

(75) Inventor: Ming-Hsien Hsu, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 898 days.

(21) Appl. No.: 12/334,526

(22) Filed: Dec. 15, 2008

(65) Prior Publication Data

US 2010/0109811 A1 May 6, 2010

(30) Foreign Application Priority Data

Oct. 31, 2008 (CN) ..... 2008 1 0305331

(51) Int. Cl.
*H01P 1/203* (2006.01)

(52) U.S. Cl. ..... 333/204; 333/219

(58) Field of Classification Search ..... 333/202, 333/204, 205, 219, 235
See application file for complete search history.

(56) References Cited

U.S. PATENT DOCUMENTS

| | | | | |
|---|---|---|---|---|
| 5,534,831 | A | 7/1996 | Yabuki et al. | |
| 2001/0024150 | A1 * | 9/2001 | Iio et al. | 333/202 |
| 2007/0001787 | A1 * | 1/2007 | Kayano | 333/204 |

* cited by examiner

*Primary Examiner* — Benny Lee
*Assistant Examiner* — Gerald Stevens
(74) *Attorney, Agent, or Firm* — Altis Law Group, Inc.

(57) ABSTRACT

A band-pass filter includes an input portion inputting an electromagnetic signal, an output portion outputting the electromagnetic signal, a plurality of transmission portions electrically connecting the input portion and the output portion to transmit the electromagnetic signal therebetween, and a pair of coupling members each shaping the frequency of the band-pass filter. Each of the coupling members includes a first coupling portion electrically connecting two of the transmission portions and a second coupling portion electrically connecting the first coupling portion. The first coupling portion includes a pair of parallel coupling microstrip lines of the same size. The second coupling portion includes a pair of transmission lines of different sizes.

18 Claims, 4 Drawing Sheets

BAND-PASS FILTER

BACKGROUND

1. Technical Field

The present disclosure generally relates to filters, and more particularly to a band-pass filter.

2. Description of Related Art

Conventionally, when a wireless network device operates at high power, harmonic components of high frequency are generated due to the nonlinear properties of the active components of the device, causing electromagnetic interference (EMI).

To address this, a filter is often used to suppress the harmonic components. Some manufacturers use a waveguide element, such as a microstrip, formed on a printed circuit board of the device.

Features of an ideal filter are signal attenuation of zero within a pass band, becoming infinite within a stop band, and transition as sharp as possible from the pass band to the stop band, providing the shortest possible distance between a transmission zero point and the stop band. In addition, increased transmission zero points improve performance of the filter in suppression of harmonic noise. However, most filters have only one transmission zero point and are thus unable to achieve or approach these ideals.

Therefore, a need exists in the industry to overcome the described limitations.

DETAILED DESCRIPTION OF THE EMBODIMENTS

Figure 1:
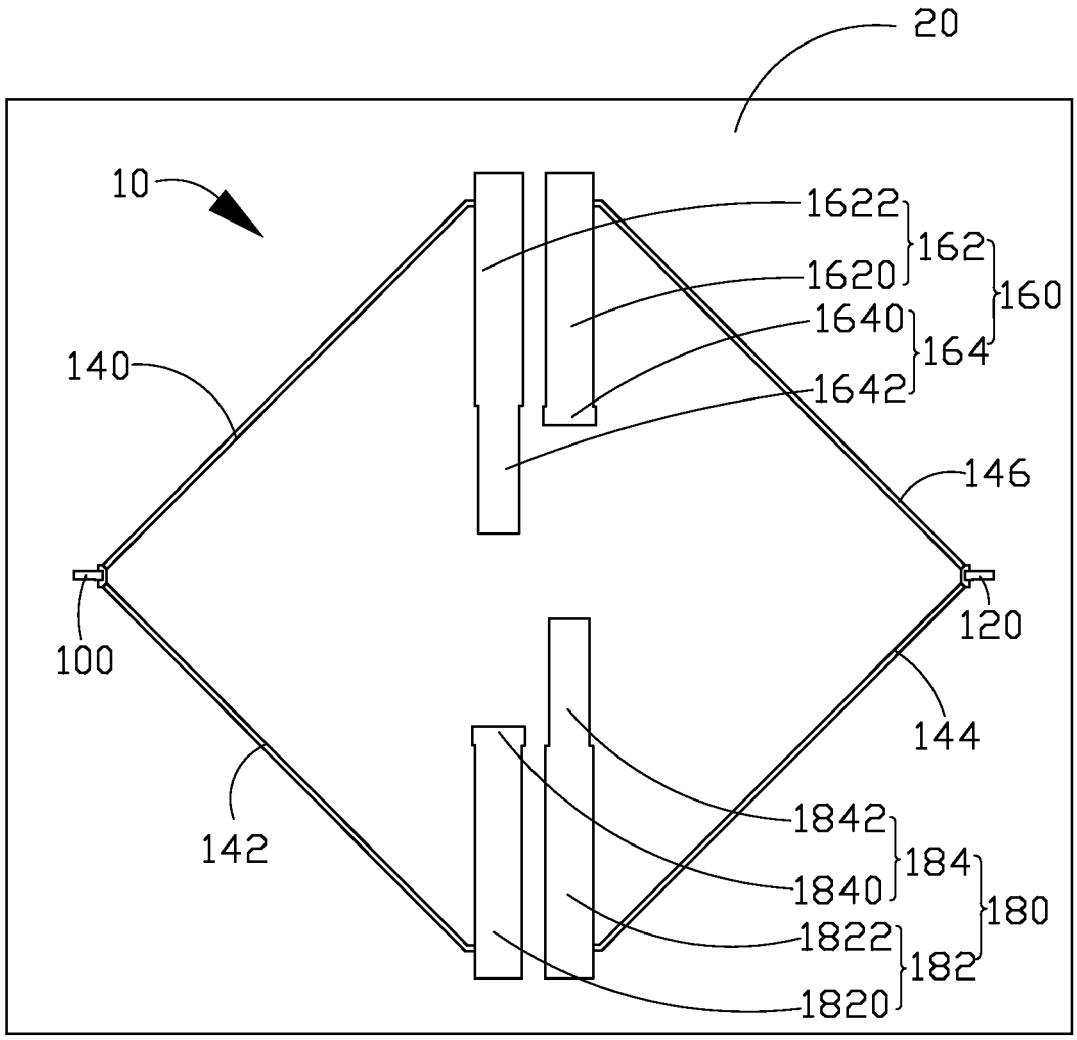
FIG. 1 is a schematic diagram of a band-pass filter of an exemplary embodiment of the disclosure.

FIG. 1 is a schematic diagram of a band-pass filter 10 of an exemplary embodiment of the present disclosure. The band-pass filter 10 is a microstrip filter printed on a printed circuit board (PCB) 20.

The band-pass filter 10 is rhomboid and includes an input portion 100, an output portion 120 aligned with the input portion 100, four transmission portions 140, 142, 144, and 146, a first coupling member 160, and a second coupling member 180. The four transmission portions 140, 142, 144, and 146 are the four borders of the rhombus. The transmission portion 140 is parallel to the transmission portion 144, and the transmission portion 142 is parallel to the transmission portion 146. The input portion 100 and the output portion 120 are disposed at the outer opposite angles of the rhombus, and the first coupling member 160 and the second coupling member 180 are asymmetrically disposed at the inner opposite angles of the rhombus. Alternatively, the band-pass filter 10 may be rectangular.

In this embodiment, an angle between the transmission portion 140 and the transmission portion 142 is 90 degrees (°), as is an angle between the transmission portion 144 and the transmission portion 146.

The input portion 100 inputs electromagnetic signals. The output portion 120 outputs the electromagnetic signals. The input portion 100 and the output portion 120 each have impedance values of approximately 50 ohms (Ω).

The transmission portions 140, 142, 144, and 146 electrically connect the input portion 100 to the output portion 120, transmitting the electromagnetic signals therebetween.

The first coupling member 160 shapes the frequency of the band-pass filter 10, and comprises a first coupling portion 162 electrically connecting the transmission portions 140 and 146, and a second coupling portion 164 electrically connecting the first coupling portion 162. The first coupling portion 162 comprises a first transmission line 1620 and a second transmission line 1622 parallel to the first transmission line 1620. The first transmission line 1620 and the second transmission line 1622 are formed of parallel coupling microstrip lines. An angle between the first transmission line 1620 and the transmission portion 146 is 45°, and an angle between the second transmission line 1622 and the transmission portion 140 is 45°.

The second coupling portion 164 comprises a third transmission line 1640 electrically connecting to the first transmission line 1620 and a fourth transmission line 1642 electrically connecting to the second transmission line 1622. The fourth transmission line 1642 generally roughly shapes the frequency of the band-pass filter 10 to the 1.5 GHz range, and the third transmission line 1640 precisely shapes the frequency of the band-pass filter 10 to 1575.42 MHz. The central line of the first transmission line 1620 is the same as that of the third transmission line 1640. The central line of the second transmission line 1622 is the same as that of the fourth transmission line 1642.

The second coupling member 180 shapes the frequency of the band-pass filter 10 and comprises a third coupling portion 182 electrically connecting the transmission portions 142 and 144, and a fourth coupling portion 184 electrically connecting third coupling portion 182. The third coupling portion 182 comprises a fifth transmission line 1820 and a sixth transmission line 1822 parallel to the fifth transmission line 1820. The fifth transmission line 1820 and the sixth transmission line 1822 are formed parallel coupling microstrip lines. An angle between the fifth transmission line 1820 and the transmission portion 142 is 45°, and an angle between the sixth transmission line 1822 and the transmission portion 144 is 45°.

The fourth coupling portion 184 comprises a seventh transmission line 1840 electrically connecting the fifth transmission line 1820 and a eighth transmission line 1842 electrically connecting the sixth transmission line 1822. The eighth transmission line 1842 roughly shapes the frequency of the band-pass filter 10 to the 1.5 GHz range, and the seventh transmission line 1840 precisely shapes the frequency of the band-pass filter 10 to 1575.42 MHz. The central line of the fifth transmission line 1820 is the same as that of the seventh transmission line 1840. The central line of the sixth transmission line 1822 is the same as that of the eighth transmission line 1842. In this embodiment, the eighth transmission line 1842 is opposite to the third transmission line 1640, and the seventh transmission line 1840 is opposite to the fourth transmission line 1642, namely, the second coupling portion 164 and the fourth coupling portion 184 are asymmetric.

The width of the third transmission line 1640 exceeds that of the first transmission line 1620, and the length of the third transmission line 1640 is smaller than that of the first transmission line 1620, that is, the length and width of the first transmission line 1620 are different from those of the third transmission line 1640. The width of the second transmission line 1622 exceeds that of the fourth transmission line 1642, and the length of the fourth transmission line 1642 is smaller than that of the second transmission line 1622, that is, the length and width of the second transmission line 1622 are different from those of the fourth transmission line 1642. That is, the sizes of the transmission lines 1620, 1622 of the first coupling portion 162 are different from those of the transmission lines 1640, 1642 of the second coupling portion 164.

The width of the third transmission line 1640 exceeds that of the fourth transmission line 1642, and the length of the fourth transmission line 1642 exceeds that of the third transmission line 1640, that is, the second coupling portion 164 comprises two transmission lines 1640, 1642 of different sizes. The length and width of the first transmission line 1620 are equal to those of the second transmission line 1622, that is, the first coupling portion 160 comprises two transmission lines 1620, 1622 of the same size.

The width of the seventh transmission line 1840 exceeds that of the fifth transmission line 1820, and the seventh transmission line 1840 is shorter than the fifth transmission line 1820, that is, the length and width of the fifth transmission line 1820 are different from those of the seventh transmission line 1840. The width of the eighth transmission line 1842 is less than that of the sixth transmission line 1822, and the eighth transmission line 1842 is shorter than the sixth transmission line 1822, that is, the length and width of the sixth transmission line 1822 are different from those of the eighth transmission line 1842. That is, the sizes of the transmission lines 1820, 1822 of the third coupling portion 182 are different from those of the transmission lines 1840, 1842 of the fourth coupling portion 184.

The width of the seventh transmission line 1840 exceeds that of the eighth transmission line 1842, and the length of the eighth transmission line 1842 exceeds that of the seventh transmission line 1840, that is, the fourth coupling portion 184 comprises two transmission lines 1840, 1842 of different sizes. The length and width of the fifth transmission line 1820 are equal to those of the sixth transmission line 1822, that is, the third coupling portion 182 comprises two transmission lines 1820, 1822 of the same size.

Figure 2:
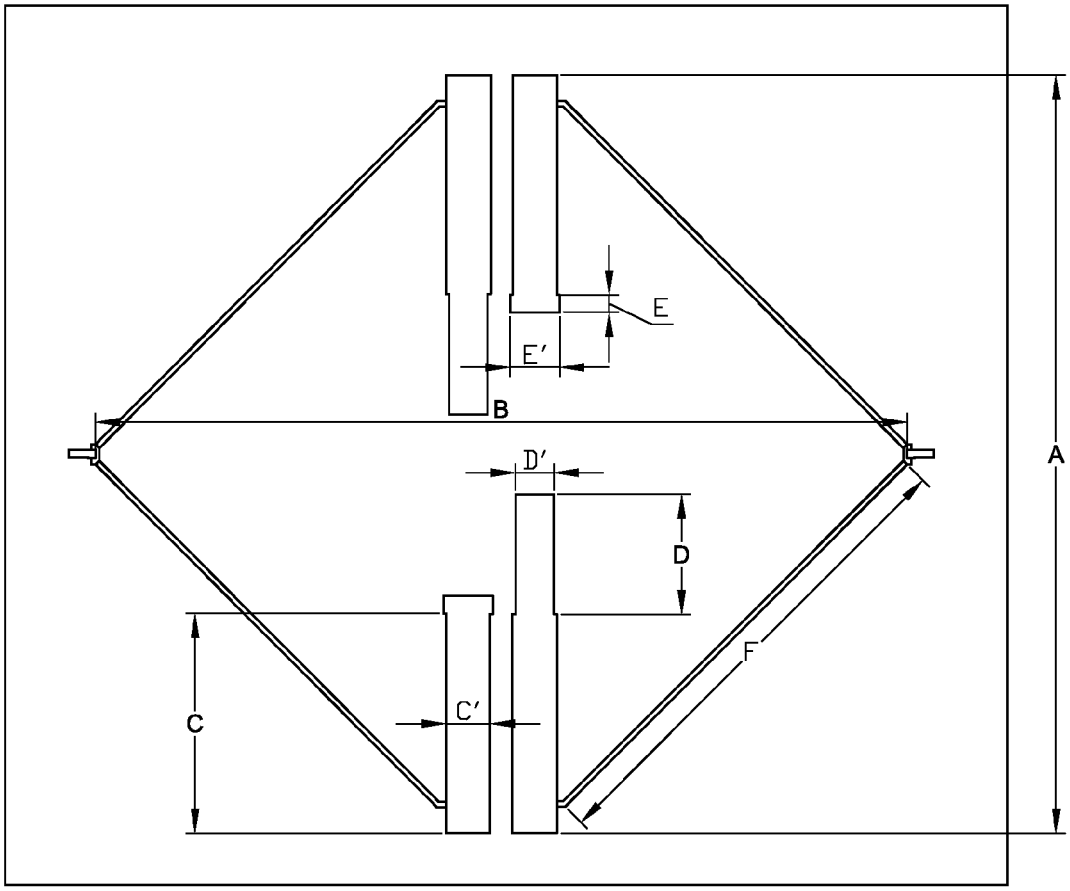
FIG. 2 is a schematic diagram illustrating dimensions of the band-pass filter of FIG. 1.

FIG. 2 is a schematic diagram illustrating dimensions of the band-pass filter 10 of FIG. 1. In this embodiment, the length B of the diagonal between the input portion 100 and the output portion 120 is generally 18.5 mm, and the length A of the diagonal between the first coupling member 160 and the second coupling member 180 is generally 16.9 mm. The length C of the fifth transmission line 1820 is 4.9 mm, and the width C' of the fifth transmission line 1820 is 1.0 mm. The lengths and widths of the first transmission line 1620, the second transmission line 1622, and the sixth transmission line 1822 are each equal to the length and width of the fifth transmission line 1820. The length D of the eighth transmission line 1842 is 2.7 mm, and the width D' of the eighth transmission line 1842 is 0.9 mm. The length and width of the fourth transmission line 1642 are equal to those of the eighth transmission line 1842. The length E of the third transmission line 1640 is 0.4 mm, and the width E' of the third transmission line 1640 is 1.1 mm. The length and width of the seventh transmission line 1840 are equal to those of the third transmission line 1640. The lengths F of the transmission portions 140, 142, 144, and 146 are each 12 mm, the widths of the transmission portions 140, 142, 144, and 146 are each 0.1 mm.

Figure 3:
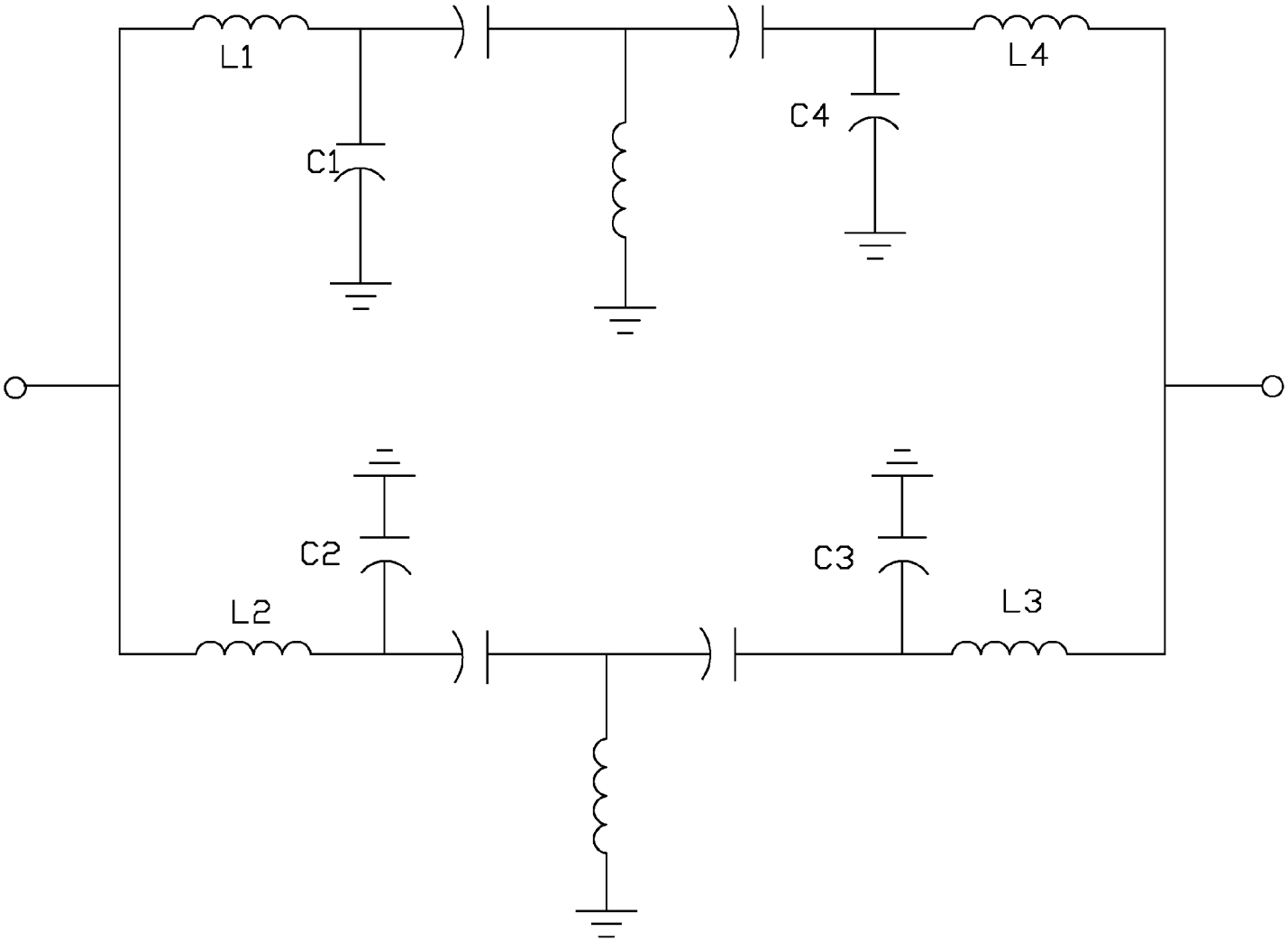
FIG. 3 is a schematic diagram of an equivalent circuit of the band-pass filter of FIG. 1.

FIG. 3 is a schematic diagram of an equivalent circuit of the band-pass filter 10. As shown, the four transmission portions 140, 142, 144, and 146 are equivalent to an inductor L1, an inductor L2, an inductor L3, and an inductor L4, respectively. Capacitors C1, C2, C3, and C4 are respectively formed between the four transmission portions 140, 142, 144, and 146 and the ground of the PCB 20. The first coupling member 160 is equivalent to the T-shaped filter between the inductor L1 and the inductor L4. The second coupling member 180 is equivalent to the T-shaped filter between the inductor L2 and the inductor L3.

Figure 4:
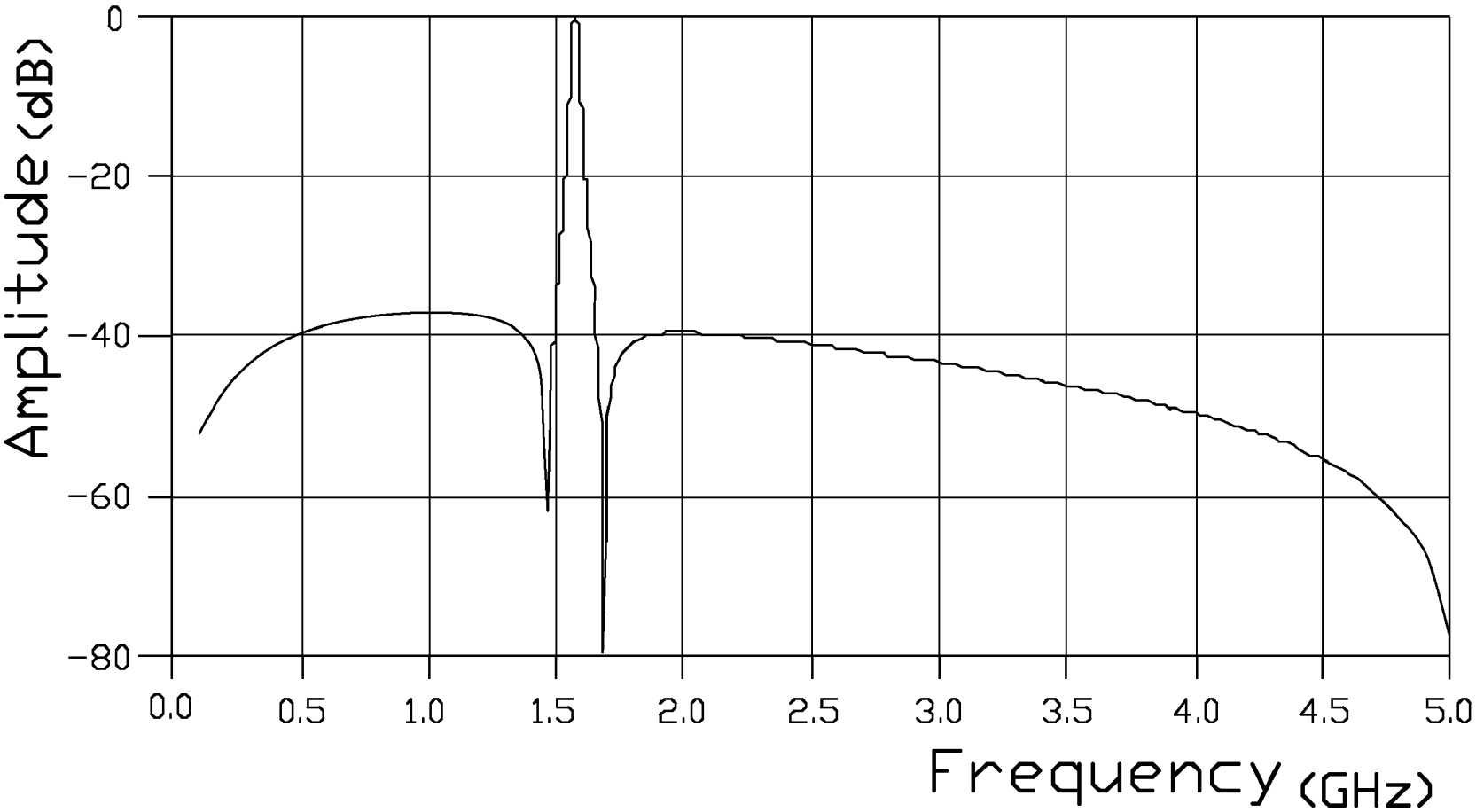
FIG. 4 is a diagram showing a relationship between amplitudes of insertion loss and frequency of electromagnetic signals through the band-pass filter of FIG. 1.

FIG. 4 is a diagram showing a relationship between amplitudes of insertion and frequency of an electromagnetic signal through the band-pass filter 10. The horizontal axis represents the frequency in gigahertz (GHz) of the electromagnetic signal traveling through the band-pass filter 10, and the vertical axis represents amplitudes of the insertion in decibels (dB) of the band-pass filter 10.

The curve S21 indicates a relationship between input power and output power of electromagnetic signals traveling through the filter 10, represented by the formula:

$$S21=10*\text{Log}\,[(\text{Output Power})/(\text{Input Power})].$$

For a filter, when the output power of the electromagnetic signal in a pass band frequency range approaches the input power of the electromagnetic signal, distortion of the electromagnetic signal is low and performance of the band-pass filter increased. As shown by curve S21 of FIG. 4, the absolute value of the insertion loss of the electromagnetic signal in the pass band frequency range is close to 0, indicating that band-pass filter 10 performs well.

As shown in FIG. 4, two transmission zero points (e.g., rejections) are generated because the width of the first low impedance transmission portion 162 is different from that of the second low impedance transmission portion 164, so that the band-pass filter 10 can effectively suppress harmonic noise. Therefore, filtering by the band-pass filter 10 is improved.

While an embodiment of the present disclosure has been described, it should be understood that it has been presented by way of example only and not by way of limitation. Thus the breadth and scope of the present disclosure should not be limited by the above-described exemplary embodiments, but should be defined only in accordance with the following claims and their equivalents.

What is claimed is:

1. A band-pass filter printed on a printed circuit board, the band-pass filter comprising:

an input portion enabling input of an electromagnetic signal;

an output portion enabling output of the electromagnetic signal;

a plurality of transmission portions electrically connecting the input portion and the output portion to transmit the electromagnetic signal therebetween; and a pair of coupling members each shaping a frequency of the band-pass filter, each of the pair of coupling members comprising a first coupling portion electrically connecting two of the plurality of transmission portions and a second coupling portion electrically connected to the first coupling portion, the first coupling portion in each of the pair of coupling members comprising a pair of parallel coupling microstrip lines of the same size, and the second coupling portion in each of the pair of coupling members comprising a pair of transmission lines of different sizes;

wherein one of the pair of transmission lines of the second coupling portion in each of the pair of coupling members roughly shapes the frequency of the band-pass filter, the other of the pair of transmission lines of the second coupling portion precisely shapes the frequency of the band-pass filter.

2. The band-pass filter as recited in claim 1, wherein the sizes of the pair of parallel coupling microstrip lines of the first coupling portion in each of the pair of coupling members are different from those of the pair of transmission lines of the second coupling portion in each of the pair of coupling members.

3. The band-pass filter as recited in claim 1, wherein an angle between any one of the pair of parallel coupling microstrip lines of the first coupling portion in each of the pair of coupling members and its adjacent transmission portion from the plurality of transmission portions is 45°.

4. The band-pass filter as recited in claim 3, wherein an angle between the two adjacent transmission portions from the plurality of transmission portions is 90°.

5. The band-pass filter as recited in claim 1, wherein the band-pass filter forms a parallelogram, the input portion and the output portion are located at outer opposite angles of the parallelogram, and the pair of coupling members are located at inner opposite angles of the parallelogram.

6. The band-pass filter as recited in claim 5, wherein the second coupling portion of one of the pair of coupling members and the second coupling portion of the other are asymmetric.

7. The band-pass filter as recited in claim 5, wherein the parallelogram is rhomboid.

8. A band-pass filter comprising:

an input portion inputting an electromagnetic signal;

an output portion for outputting the electromagnetic signal;

a plurality of transmission portions electrically connected to the input portion and the output portion to transmit the electromagnetic signal therebetween; and a pair of coupling members each electrically connecting two of the plurality of transmission portions and shaping a frequency of the band-pass filter;

wherein the band-pass filter forms a rhomboid, the input portion and the output portion are located at outer opposite angles of the rhomboid, and the pair of coupling members are asymmetrically located at inner opposite angles of the rhomboid.

9. The band-pass filter as recited in claim 8, wherein each of the coupling members comprises a first coupling portion and a second coupling portion electrically connecting the first coupling portion, the first coupling portion in each of the pair of coupling members comprising a pair of parallel coupling microstrip lines, and the second coupling portion in each of the pair of coupling members comprising a pair of transmission lines.

10. The band-pass filter as recited in claim 9, wherein one of the pair of transmission lines of the second coupling portion in each of the pair of coupling members roughly shapes the frequency of the band-pass filter, the other of the pair of transmission lines of the second coupling portion precisely shapes the frequency of the band-pass filter.

11. The band-pass filter as recited in claim 9, wherein the sizes of the pair of parallel coupling microstrip lines of the first coupling portion in each of the pair of coupling members are different from those of the pair of transmission lines of the second coupling portion in each of the pair of coupling members.

12. The band-pass filter as recited in claim 9, wherein an angle between any one of the pair of parallel coupling microstrip lines of the first coupling portion in each of the pair of coupling members and its adjacent transmission portion from the plurality of transmission portions is 45°.

13. The band-pass filter as recited in claim 12, wherein an angle between the two adjacent transmission portions from the plurality of transmission portions is 90°.

14. A microstrip filter comprising:

an input portion inputting an electromagnetic signal;

an output portion for outputting the electromagnetic signal;

a plurality of transmission portions electrically connected to the input portion and the output portion to transmit the electromagnetic signal; and a pair of coupling members each shaping a frequency of the microstrip filter, each of the pair of coupling members comprising a first coupling portion electrically connecting two of the plurality of transmission portions and a second coupling portion electrically connecting the first coupling portion, the first coupling portion in each of the pair of coupling members comprising a pair of parallel coupling microstrip lines of the same size;

wherein the second coupling portion in each of the pair of coupling members comprising a pair of transmission lines, one of the pair of transmission lines of the second coupling portion in each of the pair of coupling members roughly shapes the frequency of the band-pass filter, the other of the pair of transmission lines of the second coupling portion precisely shapes the frequency of the microstrip filter.

15. The microstrip filter as recited in claim 14, wherein the sizes of the pair of parallel coupling microstrip lines of the first coupling portion in each of the pair of coupling members are different from those of the pair of transmission lines of the second coupling portion in each of the pair of coupling members.

16. The microstrip filter as recited in claim 14, wherein the microstrip filter forms a parallelogram, the input portion and the output portion are located at outer opposite angles of the parallelogram, and the pair of coupling members are asymmetrically located at inner opposite angles of the parallelogram.

17. The microstrip filter as recited in claim 16, wherein the parallelogram is a rhomboid.

18. The microstrip filter as recited in claim 14, wherein an angle between any one of the pair of parallel coupling microstrip lines of the first coupling portion in each of the pair of coupling members and its adjacent transmission portion from the plurality of transmission portions is 45°.

* * * * *